United States Patent [19]

Nagaraj et al.

[11] Patent Number: 4,720,339

[45] Date of Patent: Jan. 19, 1988

[54] FLOTATION BENEFICIATION PROCESS FOR NON-SULFIDE MINERALS

[75] Inventors: D. R. Nagaraj, Stamford; Alan S. Rothenberg, Norwalk; Alexander S. Lambert, Bethel, all of Conn.

[73] Assignee: American Cyanamid Company, Stamford, Conn.

[21] Appl. No.: 711,924

[22] Filed: Mar. 15, 1985

[51] Int. Cl.[4] ..... B03D 1/14

[52] U.S. Cl. ..... 209/167; 209/5

[58] Field of Search ..... 209/5, 167

[56] References Cited

U.S. PATENT DOCUMENTS

| | | | |
|---|---|---|---|
| 4,133,750 | 1/1979 | Burress | 209/166 |
| 4,171,261 | 10/1979 | Dorrepaal et al. | 209/166 |
| 4,330,398 | 5/1982 | Alford | 209/166 |
| 4,360,425 | 11/1982 | Lim et al. | 209/5 |
| 4,372,844 | 2/1983 | Bresson et al. | 209/166 |
| 4,488,959 | 12/1984 | Agar | 209/166 |
| 4,545,898 | 10/1985 | Helsten | 209/167 |

*Primary Examiner*—Bernard Nozick

*Attorney, Agent, or Firm*—Frank M. Van Riet; John W. Cornell

[57] ABSTRACT

An improved method of separating non-sulfide value minerals from non-sulfide ores is disclosed. The improved method includes the step of adding a depressant selective for siliceous gangue minerals and materials to a flotation slurry previously conditioned with an anionic collector. In preferred embodiments, the depressants comprise copolymers or terpolymers derived from acrylamide units and N-acrylamidoglycolic acid units. The method provides generally improved recoveries of non-sulfide value minerals at higher grade, in a reduced number of flotation steps and at reduced consumption levels of flotation reagents.

16 Claims, No Drawings

FLOTATION BENEFICIATION PROCESS FOR NON-SULFIDE MINERALS

BACKGROUND OF THE INVENTION

The present invention relates to a new and improved process for flotation beneficiation of non-sulfide value minerals from ores containing them together with substantial quantities of associated siliceous gangue minerals and materials. More particularly, it relates to a new and improved process wherein a depressant compound is employed in non-sulfide flotations employing anionic collectors to provide improved grade and recovery of valuable non-sulfide minerals in a reduced number of flotation steps.

Froth flotation is one of the most widely used processes for beneficiating ores containing valuable minerals. It is especially useful for separating finely ground valuable minerals from their associated gangue or for separating valuable minerals from one another. The process is based on the affinity of suitably prepared mineral surfaces for air bubbles. In froth flotation, a froth or a foam is formed by introducing air into an agitated pulp of the finely ground ore in water containing a frothing or foaming agent. A chief advantage of separation by froth flotation is that it is a relatively efficient operation at a substantially lower cost than many other processes.

Current theory and practice state that the success of a froth flotation process depends to a great degree on reagents called collectors that impart selective hydrophobicity to the value mineral that has to be separated from other minerals. Thus, the flotation separation of one mineral species from another depends upon the relative wettability of mineral surfaces by water. Typically, the surface free energy is purportedly lowered by the adsorption of heteropolar collectors. The hydrophobic coating thus provided acts in this explanation as a bridge so that the mineral particles may be attached to an air bubble. The practice of this invention is not, however, limited by this or other theories of flotation.

In addition to the collectors, several other reagents may also be necessary for successful results. Among these, the frothing agents are used to provide a stable flotation froth, persistent enough to facilitate the mineral separation, but not so persistent that it cannot be broken down to allow subsequent processing.

Moreover, certain other important reagents such as the modifiers are also largely responsible for the success of flotation separation of minerals. Modifiers include all reagents whose principal function is neither collecting nor frothing but one of modifying the surface of the mineral so that a collector either adsorbs to it or does not. Modifying agents can thus be considered as depressants, activators, pH regulators, dispersants, deactivators, etc. Often, a modifier may perform several functions simultaneously.

The present invention is primarily directed to the flotation of non-sulfide minerals which present special problems by virtue of the great similarity between the surface properties of the value non-sulfide minerals and the surface properties of the non-sulfide gangue minerals. It is often the case that the differences between flotation characteristics of various non-sulfide minerals are not any greater than those between samples of a single mineral from different deposits. As can be appreciated, efficient and selective separation of one mineral from other non-sulfide value minerals and gangue minerals is a sensitive operation which depends upon a large number of variables.

Non-sulfide minerals respond to flotation with a large number of anionic collectors such as carboxylates, for example the fatty acids, and sulfonates and sulfonates. The fatty acids are used most commonly in commercial applications because of their low cost and effectiveness. Fatty acids are quite often non-selective, however, requiring a careful adjustment of flotation conditions, and it is generally necessary to use appropriate modifiers. The fatty acid collectors have a high surface activity which introduces non-selectivity to the system and in many flotation systems the problems of non-specific flotation remain largely unresolved.

In prior art non-sulfide flotation systems wherein fatty acids are used as the collectors, the use of modifying agents of an inorganic type such as sodium phosphates, sodium fluoride, hydrofluoric acid, sodium silicate, chromates and cichromates, as well as, organic modifiers such as starches, guars and tannins, has been essential to achieve selectivity in the systems. The mechanisms by which these reagents react, however, have remained secure, primarily because of the lack of systematic data in the literature on their use.

Flotation of mineral particles results from the attachment of gas bubbles to the particles while they are suspended in aqueous solutions. The attachment during contact itself is governed by, among other things, the interfacial properties of the minerals and the gas bubbles, as well as, changes in such properties brought about by the addition of various chemicals. The long chain organic electrolytes used in the past as collectors for non-sulfide minerals possess one or more ionic groups and the role of these polar groups in governing non-sulfide flotation is indeed a major one. The ionic head determines whether the collector is anionic or cationic and whether it is completely or partially ionized. In the case of weakly ionizable fatty acids which are widely used for flotation of non-sulfide minerals, it is important to consider their ionomolecular composition and the effect of the composition on the formation of insoluble salts or ionomolecular complexes. [See Hanna, H. S. and Somasundaran, P., "Flotation of Salt-type Minerals," Chap. 8, FLOTATION, Gaudin Memorial Volume 1, Publ. AIME, 1976, pp. 197–272.]

More particularly, fatty acids undergo dissociation as follows:

$$RCOOH \rightleftharpoons RCOO^- + H^+.$$

The resulting ion forms insoluble salts with multivalent metal ions such as $Ca^{2+}$ and $Mg^{2+}$. Both the solubility of such collectors and their metallic salts, as well as, their flotation properties are dependent upon chain length, the presence of double bonds in the collector and the co-existence of neutral surfactant molecules and collectors in the solution. These ionic electrolytes have generally been used in combination with extenders generally comprising hydrocarbon oils such as kerosene oil, fuel oil, diesel oil, etc. The use of these hydrocarbon extenders in combination with fatty acid collectors has found commercial application and has provided a considerable improvement in metallurgy as compared with the use of the fatty acid collectors alone.

Although a number of inorganic electrolytes are used in the flotation of non-sulfide minerals either as pH modifiers or as depressants and activators, their roles are not clearly established. These electrolytes are considered to be essential for the formation of hydrophobic multilayers on mineral surfaces but, on the other hand, they are also considered to be harmful due to precipitation as metal salts in the pulp, thereby decreasing the amount of collector available for flotation.

Since the separation of non-sulfide minerals from one another is extremely difficult and sensitive especially when the minerals contain common cations, modifiers are invariably used for obtaining or improving selectivity, as mentioned earlier. In addition to the pH modifying agents, modifiers commonly used include inorganic reagents such as sodium silicate, polyphosphates and aluminum salts as well as organic reagents such as starch, dextrin, tannin, guar gums and the like. pH modifiers are used to produce optimum alkalinity or acidity necessary for the flotation of the desired mineral. While most non-sulfide minerals can be floated using fatty acids in a slightly alkaline medium, the carbonate minerals such as calcite and dolomite respond well to both slightly acidic or alkaline pulps. Flotation of calcite in the pH range of 7–11 is lower than that obtained at other pH values. The interactions of various inorganic and organic modifiers on the flotation of non-sulfide minerals can be attributed to the following four major effects [See Eigeles, M. A., "Selective Flotation of Non-Sulfide Minerals", Prog. Mineral Dressing, Trans. 4th Intl. Minl. Proc. Congr., Stockholm, 1957, Alonquist & Wiksell, 1958, pp. 591–609 and Eigeles, M. A., "Modifiers in the Flotation Process", 1977, "Nedra", Moskow, 216 pp.]:

(1) the effect of the modifier directly on the mineral properties such as surface charge and adsorption capacity for the collector;
(2) reduction in the adsorption of collector on the mineral surface owing to the coating of the surface by the modifier;
(3) the effect on the solution chemistry of the flotation pulp; and
(4) the effects on the frothing characteristics.

One of the most commonly used modifiers in non-sulfide flotation is sodium silicate. Its use is often observed to enhance flotation of calcite, phosphorite, apatite and barite from quartz. Sodium silicate is believed to act in these cases by depressing quartz, as well as, by dispersing the slimes that are often present in the pulps. The problem, however, is that the effect of sodium silicate is often unpredictable and tends to be extremely ore specific. Also, very large dosages are often required. Both the mode of preparation of silicate and the ratio of $SiO_2$ to $Na_2O$ are shown to play a role in determining the effectiveness of the silicates as depressants. The ratio of $SiO_2$ to $Na_2O$ is believed to be important only above a pH of about 7.0 and at high concentration of silicate. Indirectly, this is probably related to the degree of polymerization of silicates rather than the ratio itself. Contrary to its depressor role at relatively high concentrations, soluble silicate has also been reported to act as an activator at lower levels for the flotation of apatite, cerrusite and malachite. This has been attributed to the interaction of the silicates with polyvalent cations to form insoluble compounds, thereby reducing the interference by these cations on flotation. Some investigators have reported the adsorption of carbonate on phosphate or calcite to be essential for the selective adsorption of water glass at high pH values. The favorable effect of aluminum salts in certain systems, such as those for separation of fluorite from calcite using sodium silicate, has also been reported. In this case, the aluminum salt is considered to aid the fluorite/calcite separation by reducing the depressing action of sodium silicate on fluorite. In addition to its use on metal ions, sodium silicate has also been used in combination with polyacrylamide or starch in the flotation of scheelite, calcite, barite and fluorite ores. [See Hanna, et al, above cited.]

The depressing action of various polyvalent cations and anions on the fatty acid flotation of non-sulfides has been attributed to precipitation of the collector. On the other hand, the presence of polyvalent cations is also known to enhance the flotation of non-sulfides under certain conditions. The commonly used inorganic modifiers in addition to sodium silicate include chromates, dichromates, phosphates, polyphosphates, fluorides and inorganic acids. For example, chromates and dichromates are used individually or in combination with organic colloids for the selective depression of barite. The depressing action of the polyphosphates in the flotation of magnesite from dolomite is believed to be due to the reduction of fatty acid availability and to the dispersion of dolomite slimes from the magnesite surface, as well as, to the selective adsorption of the polyphosphate on dolomite.

Organic modifying agents such as starch, tannin, quebracho, guars and lignins have been used for a number of years for increasing selectivity during non-sulfide flotation. Except for some short-chain organic acids, these reagents are characterized by their high molecular weight, on the order of $10^5$, as well as, by the presence of a number of strongly hydrated polar groups such as OH, COOH, $—NH_2$, $SO_3H$ and CHO, etc. There are essentially four types of organic modifiers, including (a) anionic compounds, such as starches and tannins; (b) cationic reagents; (c) heteropolar compounds, such as proteins, and (d) non-ionic compounds such as carbohydrates. [See both articles by Eigeles, M. A., above cited].

Anionic compounds such as starches and tannins have been the most popular modifiers for many years. Starches are used in the cationic flotation of quartz from iron and phosphate ores. In this application, starch is believed to depress hematite and phosphate. Starch is also used as a depressant for iron oxides, ilmenite, carbonates, monazite and for the selective flotation of calcite, fluorite and barite from each other using fatty acids as collectors. In these systems, starch depresses calcite, barite and quartz while permitting the fluorite to float. Tannin and quebracho have also been used for the depression of carbonate minerals. Although many of these organic modifiers have been used for many years, the understanding of their depressant action is rather poor. The depressing property of starch is reported to be influenced by the mineral characteristics; the type of starch; the extent of its branching and the number of functional groups on the starch backbone; its mode of preparation; the pH of the pulp and the electrolytes also present in the flotation pulp.

Starch constituents have been reported to form complexes with calcium. Such complex formation could also be partially responsible for the starch adsorption on calcite.

Most reagents depress flotation normally by adsorbing on the mineral particles and thus making their surface unavailable or unsuitable for the adsorption of the collector. In the case of starch and perhaps other natural polymers also, uptake of the collector may even be enhanced on the mineral being depressed in the presence of starch and yet the mineral may remain hydrophilic. This peculiar phenomena has been attributed to the characteristic helical structure of starch which can trap the collector molecules inside the helix, thereby masking the hydrophobic collector. [See Hanna et al, above cited].

In contrast to starch, which possesses a neutral alcoholic OH group with a pKa of greater than 12, tannin compounds are active due to the presence of slightly acidic phenolic OH groups having pKa in the range of 9.2 to 9.9. [See Hanna et al, above cited]. Their depressing action is believed to be due to the formation of complex phenolates or tannates on the mineral surface and also hydrogen bonding and electrostatic interaction between tannin and charged mineral surface. It is also reported that calcium tannate complexes are possible on calcium minerals. As in the case of starch, co-adsorption of tannin with oleic acid has also been observed on the surface of calcite, fluorite and barite. [See Hanna et al, above cited].

As can be seen from the above, conditions for effective froth flotation beneficiation of non-sulfide minerals depend heavily on the particular mineral to be beneficiated, as well as on various interactions of the many modifiers present in the flotation pulp. The solution chemistries involved play a very important role and a priori predictions concerning the nature of any given flotation system are difficult if not impossible to make.

By way of further illustration, this application will concentrate on phosphate ores as illustrative of non-sulfide flotations generally and the problems associated with flotation of these minerals. There are two main types of phosphate ores, namely, igneous and sedimentary types. The igneous ores are macrocrystalline in nature and are found as pegmatites and veins in association with quartz, fluorite, calcite, etc. They are much more easily amenable to flotation beneficiation than the sedimentary types which are microcrystalline. The mineral values are often in a much more finely disseminated form in the sedimentary types. Moreover, there is significant substitution with various chemical species in the sedimentary apatites. These characteristics make it particularly difficult to separate phosphates from sedimentary ores. For ores with low carbonate content, two main flotation techniques are used.

(1) direct flotation where fatty acid is used under moderately alkaline conditions to float phosphates, with modifiers used for the depression of gangue minerals; and (2) reverse flotation where amines are used in nearly neutral pulps to float the silicate or silica minerals.

Thus, the beneficiation of southeastern United States phosphates, for example, is achieved by anionic flotation of phosphates followed by cationic flotation of silica from the acid scrubbed and deslimed phosphate concentrates. The anionic flotation is conducted around pH 8–9.5 and the cationic flotation around pH 7–8. In addition to modifiers, various commercial hydrocarbon mixtures such as kerosene and fuel oil are used for increasing the flotation response and thereby reducing the consumption of other flotation reagents. When the ores are of a highly porous sedimentary type, these hydrocarbon oils, referred to as extenders, are commonly required. The presence of polyvalent cations such as $Ca^{2+}$ and $Mg^{2+}$, $Fe^{3+}$, $Al^{3+}$, etc. are known to inhibit the fatty acid flotation of phosphates and to activate the siliceous gangue thereby diluting the concentrates obtained in the fatty acid flotation step. Activation of silica during the anionic flotation of phosphates is usually reduced by adding a variety of modifiers, such as fluorides, sodium silicate, or colloidal silica.

In general, for the flotation beneficiation of non-sulfides from siliceous gangue using fatty acids, sodium silicate and sodium carbonate are used commercially to achieve some degree of success. When the gangue is calcarious, organic modifiers with or without sodium silicate are invariably used.

Currently and by way of illustration, a standard method for the beneficiation of phosphate ores is by a double float process whereby the phosphate ore is first floated with any one or more of several well known anionic reagents such as the fatty acids which leave rougher tailings low in phosphate values and a concentrate high in phosphate but also undesirably high in siliceous gangue. This first float or single float product containing considerable quantities of silica, is then scrubbed with sulfuric acid to remove the first flotation reagents, namely the fatty acids and extenders, and then again subjected to flotation using any one of the well known cationic reagents to float the silica, typically amines. The majority of the remaining silica is thereby floated away leaving the double float or second float tailings product high in phosphate values and very low in silica.

This invention relates to an improvement in this two-stage flotation beneficiation process for non-sulfide minerals, including phosphate ores, which contain substantial quantities of associated siliceous gangue minerals. Typically, crude ores are first ground or comminuted and then subjected to various physical methods of concentration to separate valuable minerals from the waste minerals which usually consist of clay, silicas and other minerals having little or no value. Much of the gangue can be removed by water washing, screening and gravity separations, but in most beneficiation processes of siliceous ores, the final and most important step is flotation. Phosphate ore deposits, particularly those in Florida are sub-surface pockets of phosphate ore which can consist mainly of about $\frac{1}{3}$ each of sand, clay and calcium fluorapatite. The phosphate contained in the matrix ranges in size from $\frac{3}{4}$ inch pebbles down to $-150$ mesh particles and generally is in the form of discrete grains with rather small amounts of included quartz sand. The free silica is normally mainly $-20$ mesh. The type and consistency of the clay varies and is mixed but generally is distributed throughout the matrix. The nature of the phosphate pebble and the size of the silica lends the matrix to an effective beneficiation process which consists of the following main steps after mining the ore: (1) washing to remove clay; (2) screening to remove the $+16$ mesh pebbles generally of a relatively high grade of material; and (3) flotation to recover the $-16$ to 150 mesh phosphate from silica and clay. Pebble rock removed by screening varies in grade from ore body to ore body but generally ranges from 65 to 75% bpl (bone phosphate of lime or tri-calcium phosphate). Constituting about 10% of the matrix, pebble phosphate is marketable without further processing.

The remaining matrix is chiefly fluorapatite and sand of varying and similar particle sizes which precludes separation by physical means. An elegant and now widely used method of separation of phosphate from sand involves two-stage flotation. In the first flotation stage, flotation reagents such as tall oil fatty acids (the collector) and fuel oil (extender) are used to float phosphate. Anionic flotation of phosphates is non-specific, especially under commercially employed conditions which are designed to produce high BPL recovery required by process economics, and the float concentrate normally contains 10–20% silica impurity. The second flotation stage further reduces the amount of silica and involves scrubbing the concentrate with sulfuric acid to remove the fatty acids (de-oiling) and thereafter floating the silica in the scrubbed concentrate with an amine collector. The final phosphate product contains about 70–75% BPL and less than 5% silica or acid insolubles and a BPL recovery of about 90–95%. Dual flotation as described above is obviously more expensive than the single stage flotation because of additional equipment and reagents needed. It is the method of choice, however, since single stage flotation often cannot provide marketable grade phosphate concomitant with satisfactory BPL recovery. Preventing complete separation with good BPL recovery is the lack of specificity of the anionic collectors for phosphate particles. Searches for more specific collectors or for a selective depressant for silica antedates the development of the two-stage flotation processes referred to above. Such efforts have met with only limited success, as evidenced by the continuing practice of using the two-stage process in phosphate production.

Prior art attempts to improve selectivity and recovery of flotation processes for non-sulfide minerals have included the use of certain synthetic gangue depressants in either the anionic or cationic flotation stages. For example, U.S. Pat. No. 3,862,028, discloses gangue depressants that are graft polymers comprised of a starch substrate onto which is grafted a member selected from the group consisting of a polymerized quaternary ammonium derivative of aminoalkyl methacrylate and mixtures of a polymerized quaternary ammonium derivative of aminoalkyl methacrylate with polyacrylamide. The graft copolymers are prepared by gamma irradiation method. In the preferred embodiment, wheat starch was irradiated with a total dosage of 5 megarads of gamma radiation with a cobalt 60 source. The irradiated starch, under a nitrogen atmosphere, was then brought into contact with a solution of monomer and allowed to react for a time sufficient to obtain maximum grafting. The quaternary ammonium derivative of aminoalkyl methacrylate monomer has the structure:

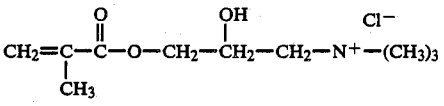

(2-hydroxy-3-methacryloyloxypropyltrimethylammonium chloride)

As disclosed in said patent, the addition levels for flotation reagents, for example, the collectors, activators, extenders or depressants, the orders of addition and the effects of the additives on each other were investigated. The addition level for the graft polymers was from about 0.025 to about 0.2 pounds per ton. The preferred level was from about 0.025 to about 0.05 pounds per ton. The preferred polymer content was from about 2.5 to 15% by weight of the quaternary ammonium monomer in the graft polymer and from about 5 to 20% by weight of acrylamide monomer in the graft copolymer, based on starch, quaternary monomer and acrylamide comonomer. It was found that the graft polymer was best added before the fatty acid collector. The polymer did improve the grade of $P_2O_5$ concentrate but only at the expense of $P_2O_5$ recovery.

The above-described starch-based depressants, as well as other water-soluble starches, dextrin, guar gums and the like, have several shortcomings. From an ecological vantage point, the presence of residual depressants such as these in the waste waters increases biological oxygen demand and chemical oxygen demand, thereby creating a pollution problem in the disposal of these waste waters. From a commercial vantage point, there are an ever-increasing number of countries in which the use of reagents having food values such as starch, is prohibited in commercial applications. Moreover, the starch type depressants require a complex preparation from the reagent solution involving a cooling stage prior to solution and the resultant reagent is susceptible to bacterial decomposition, thereby requiring storage monitoring. These natural polymers have only limited storage stability.

Another single stage flotation process for separating phosphate minerals is described in U.S. 3,351,257. As disclosed therein, anionic collectors such as fatty acids are employed in combination with certain modifiers for depressing siliceous gangue and dispersing slimes. The modifiers disclosed comprise water-soluble agents including inorganic modifiers selected from ammonium hydroxide, and the ammonium and sodium orthophosphates, metaphosphates, orthosilicates, metasilicates, fluorides and carbonates, and organic modifiers selected from sodium and calcium lignin sulfonates. Best results are obtained with sodium fluoride and the lignin sulfonates and wherein the modifier is added prior to addition of the fatty acid. The modifiers are added at dosages from 0.1 to 2.5 lbs/ton. The process disclosed in the '257 patent improved the selectivity of the flotation separation of phosphate from siliceous impurities. The process also permits the two final separation stages, e.g. acid scrubbing and amine flotation, to be eliminated in recovering phosphate values from phosphate ores. The process is also beneficial in that it provided a reduction in the need for close plant controls in critical areas, such as desliming, sizing, conditioning, and reagent rates, as well as, a reduction in flotation reagent requirements and processing costs. Phosphate recovery was also increased.

In U.S. Pat. No. 4,220,525, it is disclosed that polyhydroxyamines are useful as depressants for gangue materials including silica, silicates, carbonates, sulfates, and phosphates. Illustrative examples of the polyhydroxyamines disclosed include aminobutanetriols, aminopentitols, aminohexitols, aminoheptitols, aminoctitols, pentose-amines, hexose amines, amino-tetrols, etc.

In U.S. Pat. No. 4,360,425, assigned to the same assignee as the present invention, a method is described for improving the results of a non-sulfide froth flotation process wherein a synthetic depressant is added which contains hydroxy and carboxyl functionalities. As disclosed in U.S. Pat. No. 4,360,425, the synthetic depressant is added to the second or amine stage flotation of a double-float process for the purpose of depressing the non-sulfide mineral values i.e., phosphates, during amine flotation of the siliceous gangue materials from the second stage concentrate. This patent relates to the use of the synthetic depressant during amine flotations only, wherein the depressant is added first and then a commercially available amine collector is added later. The results in said patent indicated an improvement in the grade of non-sulfide mineral values maintained in the second stage tailings recovery by the depressant during this second amine flotation of the silica gangue.

Unexpectedly in view of the foregoing, it has now been discovered that very efficient non-sulfide mineral values separation from siliceous gangue may be obtained in an anionic flotation stage using a polymeric depressant by adding the synthetic depressant after the fatty acid collector has been added to the slurry followed by direct froth flotation. In accordance with this discovery, marketable phosphate products have been obtained in a single anionic flotation step thereby eliminating the need for acid scrubbing and subsequent amine flotation. The process of the present invention provides improved grades of non-sulfide value minerals without loss of recovery and no operational modifications are required for conventional equipment. The low molecular weight polymers are very stable and can be stored indefinitely unlike the natural polymers such as starch, dextrin, etc., heretofore employed.

Accordingly, it is an object of the present invention to provide a new and improved process for flotation beneficiation of non-sulfide value minerals from non-sulfide ores which is more efficient by permitting a reduction in the number of flotation steps and in the amounts of flotation reagents required to provide satisfactory grades and recoveries.

It is another object of the present invention to provide a new and improved process for separating non-sulfide value minerals from ores containing associated siliceous gangue minerals and materials, satisfactorily in terms of grade and recovery, and in substantially a single flotation step employing commercially available anionic colletors and plant equipment.

SUMMARY OF THE INVENTION

In accordance with these and other objects, the present invention provides a new and improved process for the beneficiation of non-sulfide value minerals from non-sulfide ores with selective rejection of siliceous gangue minerals and materials, said process comprising:

(a) providing an aqueous slurry of finely divided, liberation-sized ore particles;

(b) adjusting the pH of said slurry to a value of between about 5.0 and about 11.0, depending on the ore selected;

(c) conditioning said slurry with an effective amount of an anionic collector;

(d) thereafter, further conditioning said slurry with an effective amount of a depressant selective for siliceous gangue minerals and materials; said depressant comprising a copolymer or terpolymer derived from:

(i) x units of the formula:

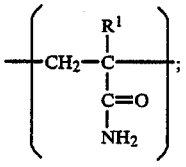

(ii) y units of the formula:

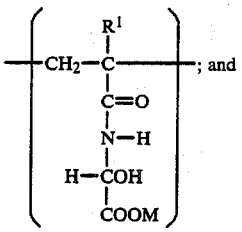

(iii) z units of the formula:

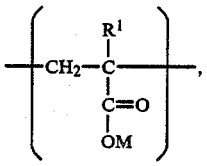

wherein $R^1$ is hydrogen or $C_1$–$C_4$ alkyl, M is hydrogen, an alkali metal cation or an ammonium ion; x represents the residual mol percent fraction; y is a mol percent fraction ranging from about 1% to about 50%; Z is a mol percent fraction ranging from about 0% to about 45% and the total molecular weight of the copolymer or terpolymer is between about 500 and about 1,000,000; and (e) collecting the non-sufide mineral by froth flotation procedures.

In a preferred embodiment, the new and improved silica depressant for use in anionic flotations in accordance with the present invention comprises about 85–95 mol percent of units of formula (i), i.e. acrylamide units, and about 10 mol percent of units of from (ii), i.e. N-acrylamidoglycolic acid salt units, and has a total molecular weight of about 5,000–50,000.

Generally, and without limitation, in accordance with the process of the present invention, the silica depressant may be added in amounts of from about 5 grams/metric ton (g/T) of ore to about 500 grams/metric ton, and preferably from about 10 g/T to about 250 g/T or, expressed differently the depressant may be added at dosages of from about 0.01 lbs/ton to about 1.0 lbs/ton or ore, and preferably from about 0.02 lbs/ton to about 0.50 lbs/ton.

The new and improved silica depressant for use in anionic flotation of non-sulfide minerals in accordance with the present invention, may be obtained commercially or may be simply prepared by reacting a polyacrylamide with glyoxylic acid in alkaline medium at temperatures of about 40° C. Although the preferred monomer units of the co- or terpolymer depressants are acrylamide, N-acrylamidoglycolic acid (salts) and acrylic acid, the co- and/or terpolymer depressants for use herein may broadly be considered to be water soluble polymers comprising nonionic and anionic monomers, and some monomer substitution from members of these general types of monomers may be tolerated and/or desired depending on the non-sulfide mineral to be beneficiated and the particular ore.

The relative order of addition between the anionic collector and the novel silica depressant, and their respective dosages, the conditioning times, pH and slurry solids concentration, are all factors which effect the results obtained with the process of the present invention, and each factor will be more particularly described hereinafter.

In general, the new and improved process of the present invention provides a very efficient method for separating non-sulfide value minerals from siliceous gangue. The process provides dramatic improvements in the grade of the mineral concentrates without losses in recovery.

Further objects, advantages and aspects of the present invention will become apparent from the following detailed description and the illustrative working examples.

DETAILED DESCRIPTION OF THE INVENTION

The present invention comprises a new and unexpected application for synthetic low molecular weight copolymers containing hydroxyl and carboxyl functionalities. More particularly, it has surprisingly been discovered that copolymers and/or terpolymers derived from:

(i) x units of the formula:

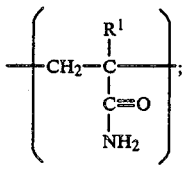

(ii) y units of the formula:

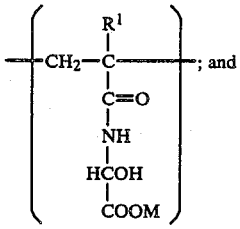

(iii) z units of the formula:

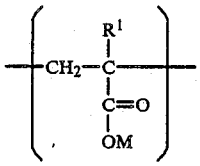

wherein $R^1$ is hydrogen or $C_1$–$C_4$ alkyl; M is hydrogen, an alkali metal cation or an ammonium ion; x represents the residual mol percent fraction; y represents a mol percent fraction of from about 1% to about 50%; z is a mol percent fraction of from about 0% to about 45% and the total molecular weight of the copolymer or terpolymer is between about 500 and about 1,000,000; are selective depressants for silica and siliceous gangue minerals or other acid insolubles in an anionic non-sulfide mineral flotation circuit, under certain conditions. This discovery is completely unexpected because the materials have previously been used to selectively depress value non-sulfide minerals such as fluoroapatite during cationic flotation of silica and acid insolubles in a second stage flotation, i.e., they have heretofore been found not to depress siliceous gangue in cationic circuits, but rather to function as selective depressants for non-sulfide value minerals. Applicants have discovered that the selective depressant action for the copolymer and terpolymers function in a directly opposite manner under anionic flotation conditions.

The preferred synthetic depressants for use in accordance with the present invention are derived from acrylamide units (i), N-acrylamidoglycolic acid (or acid salt) units (ii) and acrylic acid (or acid salt) units (iii). Especially preferred depressants for use in the method of the present invention comprise copolymers derived from (i) units and (ii) units defined above, i.e., comprise glyoxylic acid-substituted polyacrylamides, with a degree of substitution of from 1 to 50%, preferably 5 to 30%. Expressed differently the preferred copolymers comprise 49 to 99 mol % of (i) units and 1 to 50 mol percent of (ii) units, and especially preferred are copolymers comprising 70 to 95 mol % of (i) units and 5 to 30 mol percent of (ii) units.

Although the copolymers and terpolymers have been defined above with reference to the preferred monomeric units, the synthetic depressants generally can be considered to be water-soluble polymers comprising nonionic and anionic monomers, and therefore, same substitution of equivalent monomers may be made by those skilled in this art. For example, other water-soluble anionic monoethylenically unsaturated monomers which may be substituted in whole or in part for monomer units (ii) and (iii) defined above, include acrylic acid, methacrylic acid, 2-acrylamido-2-methylpropanesulfonic acid; styrene sulfonic acid, 2-sulfoethyl methacrylate, vinyl sulfonate, maleic acid, fumaric acid, crotonic acid, N-acrylamido glycolic acid, N-methacrylamidoglycolic acid, N-methylolacrylamido-N-glycolic acid and their respective alkali metal, e.g. sodium or potassium, or ammonium salts. Examples of water-soluble nonionic monoethylenically unsaturated monomers which may be substituted in whole or in part for the (i) units defined above include: acrylamide,methacrylamide, N-isopropylacrylamide, N-methylolacrylamide, hydroxyethylacrylate, hydroxyethyl/methacrylate, acrylonitrile and methacrylonitrile.

The preferred monomers however are acrylamide, N-acrylamidoglycolic acid and acrylic acid.

The depressants for use in the process of the present invention will generally have a total molecular weight of between about 500 and about 1,000,000. Preferably, the depressant employed will comprise a copolymer or terpolymer as defined above having a molecular weight of between about 2,000 and 200,000, and especially preferably between about 4,000 and 40,000.

The depressants for use herein may be prepared by modifying a polyacrylamide having the desired average molecular weight by reacting the polyacrylamide with glyoxylic acid under alkaline conditions (pH 8.0) at a temperature below about 40° C. to produce a copolymer derived from acrylamide units and N-methacrylamidoglycolic acid units. At a reaction temperature above 40° C., the reaction provides a terpolymer derived from alkaline or ammonium salts of acrylic acid, alkaline or ammonium salts of N-acrylamidoglycolic acid and acrylamide.

The term polyacrylamide is used broadly for convenience rather than to limit the process of manufacture. Further details for the preparation of these depressants may be obtained in U.S. Pat. No. 3,442,139 and 4,360,425, both patents being specifically incorporated herein by reference, and elsewhere in the patent literature.

In accordance with the method of the present invention the synthetic low molecular weight copolymers or terpolymers defined above are employed as selective depressants for siliceous gangue in a new and improved anionic flotation process for beneficiating non-sulfide value minerals.

More particularly, in accordance with the method of the present invention, an aqueous pulp slurry of finely divided, liberation-sized ore particles is provided.

As is apparent to those skilled in this art, the particle size to which an ore must be size-reduced in order the liberate mineral values from associated gangue or non-values, i.e., liberation size, will vary from ore to ore and may depend on several factors, such as, for example, the geometry of the mineral deposits within the ore, e.g., striations, agglomeration, comatrices, etc. In any event, as is common in this art, a determination that particles have been size-reduced to liberation size may be made by microscopic examination. Generally, and without limitation, suitable particle size will vary from between about −30 mesh to about 400 mesh sizes. Preferably, the ore will be size-reduced to provide flotation sized particles of between about −35 mesh and about ±200 mesh.

Size reduction of the ores may be performed in accordance with any method known to those skilled in this art. For example, the ore can be crushed to −10 mesh size followed by wet grinding in a steel ball mill to specified mesh size, or autogenous or semi-autogenous grinding or pebble milling may be used. The procedure employed in size-reducing the ore is not critical to the method of this invention, as long as particles of effective flotation size are provided.

The size-reduced ore, e.g., comprising particles of liberation sized ore, is thereafter slurried in aqueous medium to provide a flotable pulp. The solids concentration of the slurry may vary, but prior to conditioning should be between about 50% and about 90% solids and preferably between 60 and 80% solids. Especially good results have been obtained with a pulp slurry adjusted to at least about 70% solids before conditioning. The composition of the aqueous medium comprises water. Plant water or tap water containing $Mg^{2+}$ and $Ca^{2+}$ ions as well as other ions may be used, i.e. the water employed does not have to be deionized or distilled.

It has been discovered that the pH of the pulp slurry prior to conditioning should be adjusted to between about 5.0 and 11.0, depending on the type of ore. For phosphate flotation, the pH should be between 8.5 and 10.0 and preferably about 9.0, to obtain maximum selectivity of the depressant for the siliceous gangue and to obtain maximum separation of the phosphate value minerals in the anionic flotation step. pH pre-adjustment may be effected by addition of dilute base, such as dilute alkali metal or ammonium hydroxide or lime may be used.

After the pulp slurry having the desired solids content and pH is prepared, the slurry is conditioned by adding an effective amount of an anionic non-sulfide mineral collector or collector/extender combination under agitation to ensure adequate distribution and interaction of the collector with the mineral particle surfaces of the slurry. Any known anionic collector for flotation of non-sulfide minerals may be used including the carboxylates (e.g. fatty acids), sulfonates and sulfates, which are well known collectors to those skilled in this art. The collectors most commonly used are the fatty acids which are derived from a vegetable or animal oils. Vegetable oils include babassu, castor, Chinese Tallow, coconut, corn, cottonseed, grapeseed, hempseed, hapok, linseed, wild mustard, oiticica, olive, ouri-ouri, palm, palm kernel, peanut, perilla, poppyseed, Argentine rapeseed, rubberseed, safflower, sesame, soybean, sugar cane, sunflower, tall teaseed, tung and ucuhuba oils. Animal oils include oils derived from fish and livestock. These oils contain acids ranging from 6–20 carbons or more and may be saturated or unsaturated, hydroxylated or not, linear cyclic and the like. It is preferred to use a tall oil fatty acid because of commercial availability and low price.

It is preferred to employ an extender together with the anionic collector to save on cost of reagents. Suitable extenders generally comprise a petroleum based hydrocarbon oil such as kerosene or fuel oils. Generally, and without limitation, the collector and extender may be added in 1:1 weight ratio mixture. Generally, the effective amount of anionic collector may vary widely within conventionally known and used limits depending on the type and condition of the ore selected. An effective amount of anionic collector is generally in the range of about 0.20 to about 4.0 lbs of anionic collector per ton of ore. Expressed differently, a 1:1 w/w blend of fatty acid collector/fuel oil extender may be employed in amounts of from about 100 to about 2000 grams of the blend per metric ton of ore, and preferably between about 250 and 1000 g/T of ore.

The conditioning time for the anionic collector should be sufficient to provide adequate contact time for the collector to interact with the mineral surfaces. Typically, conditioning under agitation should last for at least about one-half a minute, but generally will be for a period of between ½ to about 30 minutes depending upon the ore, preferably for 1 to 5 minutes, inclusive.

After the pulp slurry has been conditioned with an effective amount of an anionic collector, in accordance with the method of the present invention, it is thereafter conditioned with an effective amount of the synthetic copolymer or terpolymer depressant of this invention to selectively depress siliceous gangue minerals and materials. The novel silica depressant, in accordance with the present method, will be added in an amount of from about 5 grams/metric ton of ore to about 500 grams/metric ton. Preferably the modifier of this invention is added at from about 10 g/T to about 250 g/T. Expressed differently the depressant may be added at dosages of from about 0.01 lbs/ton to about 1.0 lbs/ton of ore, and preferably at from about 0.02 lbs/ton to about 0.5 lbs/ton.

After addition of the modifier the pulp slurry should be conditioned for a time sufficient to provide good interaction between the depressant and the siiceous gangue minerals and materials present in the slurry. Generally, conditioning time of from 0.5 to 10.0 minutes are sufficient, but preferably the pulp will be conditioned with the modifier for a period of from 1.0 to 5.0 minutes, inclusive.

The previous steps may be performed in various vessels prior to flotation, depending on the flotation set-up generally employed at a given location. For example, solids concentration, pH adjustment and anionic collector conditioning may all be performed in the grinding vessel, in a conditioning vessel or in the flotation cell. The modifier conditioning step can be performed in a conditioning vessel or in the flotation cell. In fact, especially good results have been obtained wherein half of the modifier was added during conditioning and the remaining half of modifier was added to the flotation cell.

It has been discovered that certain of the conditions outlined above are important to obtain a very selective separation. More particularly, better results have been obtained wherein the collector and conditioning steps are performed on a pulp slurry containing about 70% solids. The selectivity of the depressant for silica is somewhat pH dependent, because at higher pH values of above about 10.5, the depressant loses its effectiveness and both non-sulfide value minerals and silica float effectively. At pH below 5.5, the non-sulfide value minerals recovery using anionic collectors decreases. Best results were obtained with a phosphate ore in the present process wherein the pH of the slurry was preadjusted to about 9.0 prior to conditioning with the anionic collector. It was also discovered that subsequent pH adjustment was relatively unimportant.

The relative order of addition, i.e. conditioning, between the anionic collector and the modifier of this invention is important. When the modifier was added before the anionic collector in test procedures in accordance with conventional procedures for depressant materials, the grade of the value non-sulfide concentrates improved, but at the expense of recovery. This was true except for dosages of modifier at the lower end of the ranges recited above. However, when the pulp is conditioned with collector first then modifier, improved grades at the same or better recovery were unexpectedly obtained. Each of these effects will be demonstrated in the illustrative examples which follow.

After the conditioning with the modifier is substantially complete, the conditioned slurry is transferred to a flotation cell for flotation. In the frothing step a gas is introduced to the agitated slurry, and the air bubbles introduced to the slurry rise to the surface with the attached or associated non-sulfide value minerals to form a values-rich froth which may be skimmed from the surface to collect the desired minerals. The siliceous gangue minerals which are selectively depressed by the novel modifier in accordance with the present invention, do not float, but instead remain in the slurry which is left behind, said remains being referred to as "tailings". During the frothing step, the pulp in the flotation cell is generally agitated at about 1000–2000 rpm, and air is fed into the slurry at a rate of about 3–7 liters/minute from a compressed air source under laboratory conditions. Appropriate scale-up factors should be applied for large scale flotation plant operations. Flotation times are adjusted generally to provide a barren froth upon completion of the flotation.

Other objects and advantages provided by the new and improved flotation process of this invention will become apparent from the following working Examples, which are provided by way of further illustration only, to enable those skilled in this art to better understand and practice the present invention.

DESCRIPTION OF THE PREFERRED EMBODIMENT

In most of the following examples, the depressant modifier employed was a polyacrylamide substituted with approximately 10% by weight of glyoxylic acid and having sulfonate end groups. The average molecular weight of the modifier was about 5,000. Other modifiers employed, where used, are designated and described. These other modifiers were prepared by reacting polyacrylamide with glyoxylic acid in alkaline medium of approximately pH 8.0 at a temperature of less than or equal to 40° C. for a period of about 2 hours of until neutrality is reached. The reaction yields a polymer with units of acrylamide and N-acrylamidoglycolic acid salt. Reagents used for pH adjustment and/or hydrolysis include NaOH, KOH and $NH_4OH$. Terpolymers employed, if any, are prepared by running the above-described reaction at a temperature above 40° C. to hydrolyze the polyacrylamide solution to yield a polymer solution containing units of acrylamide, N-acrylamidoglycolic acid salt and acrylic acid salt. Preparation of these copolymers and terpolymers is well known to those skilled in this art. Additional teachings may also be obtained, for example, from U.S. Pat. Nos. 3,442,139 and 4,360,425, both of these patents being specifically incorporated herein by reference.

In the following Examples, flotation testing of the modifiers was performed using four different ore samples obtained from various Southeastern U.S. phosphate mines, designated as Feed A, Feed B, Feed C and Feed D. Feeds A, B and C were different Samples from the same mine and as received, had already been mostly deslimed at 150 mesh to remove the clay minerals. About 500 g of the as-received wet ore was again deslimed on a 200 mesh screen for 2 minutes and washed with water at pH 9.0 containing 33 ppm $Ca^{2+}$ species, to simulate actual plant water. These ore pulps were then conditioned in a 500 ml beaker for 2 minutes with 33 ppm $Ca^{2+}$—water at about 70% solids at pH 9.0 (adjusted with 5.0% NaOH). Thereafter, the ore pulp was conditioned for about 2 minutes with a fatty acid collector and a fuel oil extender at the prescribed dosages. pH during this conditioning step was controlled at pH 9.0 by adding 5% NaOH as required. Next, the pulp was conditioned with the novel modifier for about 2 minutes at pH 9.0. After these conditioning stages, the pulp was transferred to a 1.5 l flotation cell and the pH was quickly adjusted to 9.0. The pulp was floated at 1400 rpm and compressed air was added at a flow rate of about 5.1 l/min. until a barren froth was obtained, i.e. about 1–4 minutes. In certain comparative tests performed on Feeds A, B and C, the order of addition of fatty acid and modifier was reversed, i.e., modifier then fatty acid, as explained in the appropriate examples.

Feed D used in some examples was obtained from a different Southeastern U.S. phosphate mine. This as received wet charge was not deslimed any further. Feed D was conditioned at 74–75% solids at pH 9.0 (adjusted using 5% $NH_3$) for 2 minutes with the fatty acid collector and fuel oil extender. No further pH adjustment was performed during conditioning. The pulp was next conditioned for one minute with the novel modifier at required dosages. This conditioned pulp was then floated at 1300 rpm in a flotation cell at natural air flow until the froth was barren. The flotation pH was 7.0–7.5 during flotation.

Feeds, A, B, C and D were analyzed for size distribution and chemical analysis, the results being summarized as follows:

Feed A

Feed A had about 6% of −150 mesh slimes containing about 3% of the total phosphate. 88% of the feed was in the size range −28 to 150 mesh. About 24% of the total phosphate was in the +35 mesh fraction which comprised about 9% of the total feed weight. The total feed assay was:

$P_2O_5$—7.73% (16.85% BPL),
Insolubles 75.60%,
CaO 17.44%.

The calculated head assay was 8.4% $P_2O_5$. More particularly, size and chemical analysis of FEED A revealed the following:

TABLE A

FEED A: SIZE AND CHEMICAL ANALYSIS

| MESH SIZE | BPL | $P_2O_5$ | INSOLUBLES | % WT | %$P_2O_5$ CONTENT | % $P_2O_5$ DISTRIBUTION |
|---|---|---|---|---|---|---|
| +28 | 49.73 | 22.81 | 31.45 | 5.8 | 1.32 | 16.8 |
| 35 | 32.16 | 14.75 | 55.54 | 3.8 | 0.56 | 7.1 |
| 48 | 21.17 | 9.71 | 70.16 | 19.0 | 1.84 | 23.4 |
| 60 | 15.59 | 7.15 | 77.22 | 11.5 | 0.82 | 10.4 |
| 100 | 13.58 | 6.23 | 80.55 | 35.3 | 2.20 | 27.9 |
| 150 | 10.62 | 4.87 | 84.71 | 18.2 | 0.88 | 11.2 |
| −150 | 8.55 | 3.92 | 87.71 | 6.2 | 0.24 | 3.0 |
| | | | | 100.0 | 7.88 | 100.0 |

FEED B

Feed B had about 5% of −150 mesh slimes containing about 4.3% of the total $P_2O_5$. 86% of the feed was in the size range −35 mesh to +150 mesh. About 21% of the total phosphate was in the +35 mesh fraction which comprised about 9% of the total feed weight. The total feed assay was:

$P_2O_5$—7.23 (15.8% BPL),
Insolubles—78.00.

The calculated head assay was about 7.2$P_2O_5$.

Results of size and chemical analysis of Feed B was as follows:

TABLE B

| MESH SIZE | WT % | CUMULATIVE WT % | % $P_2O_5$ | % INSOLUBLES | % $P_2O_5$ DISTRIBUTION |
|---|---|---|---|---|---|
| +35 | 8.9 | 8.9 | 16.7 | 50.7 | 20.8 |
| +48 | 24.5 | 33.4 | 5.7 | 81.3 | 19.5 |
| +65 | 16.3 | 49.7 | 4.9 | 84.8 | 11.2 |
| +100 | 33.2 | 82.9 | 6.7 | 79.9 | 31.1 |
| +150 | 11.1 | 94.0 | 8.5 | 74.1 | 13.2 |
| −150 | 5.0 | | 6.2 | 83.3 | 4.3 |

Feed C

Feed C resembled Feed B with respect to size distribution and head assays. The feed assays were $P_2O_5$=8.27, BPL=18.03% and insolubles=75.24%.

Feed D

Feed D was used in a field test and therefore size distribution and chemical analysis data were unavailable. The feed assays for this ore were: $P_2O_5$=5.68; BPL=12.39.

EXAMPLES 1–3

In the following Examples, Feed A was used. Testing was conducted as a function of dosage of anionic collector and extender. The anionic collector used was Acintol FA-1 ® from Arizona Chemical Company. Acintol FA 1 ® is a tall oil fatty acid containing about 40% oleic acid, about 30–35% linoleic acid and about 5% of a variety of $C_{16}$–$C_{20}$ homologous fatty acids. The extender employed was a commercial No. 2 fuel oil. The fatty acid/fuel oil ratio was kept constant at 1.0. The new and improved modifier of the invention was added in some of the flotation test runs at various modifier dosages. The order of addition and order of conditioning was to add the modifier first and thereafter add the anionic fatty adic collector/fuel oil extender combination. The flotation procedures were the same as described above for Feed A. The results obtained are set forth in Table 1 as follows:

TABLE 1

PHOSPHATE FLOTATION AS A FUNCTION OF COLLECTOR DOSAGE AND MODIFIER DOSAGE
Feed A: $P_2O_5$ = 8.4; BPL = 18.3; pH = 9.0,
FATTY ACID/FUEL OIL RATIO = 1
ORDER OF ADDITION: MODIFIER THEN COLLECTOR

| EXAMPLE | COLLECTOR DOSAGE, g/T | MODIFIER DOSAGE, g/T | WT. % CONC. | ASSAY, $P_2O_5$ % CONC. | ASSAY, $P_2O_5$ % TAIL. | BPL CONC. GRADE | INSOLS. IN CONC. | BPL or $P_2O_5$ RECOVERY, % |
|---|---|---|---|---|---|---|---|---|
| A | 250 | — | 24.3 | 27.9 | 1.74 | 60.8 | 18.8 | 83.7 |
| B | 375 | — | 27.6 | 27.2 | 1.19 | 59.2 | 18.7 | 89.6 |
| C | 500 | — | 28.9 | 24.7 | 1.79 | 53.8 | 26.7 | 84.8 |
| D | 625 | — | 33.6 | 23.1 | 0.93 | 50.4 | 32.0 | 92.6 |
| E | 1000 | — | 35.1 | 23.2 | 0.87 | 50.6 | 31.4 | 93.5 |
| 1 | 625 | 12.5 | 28.2 | 25.7 | 1.29 | 56.1 | 23.8 | 88.7 |
| 2 | 625 | 25.0 | 27.9 | 26.0 | 1.39 | 56.8 | 23.0 | 87.9 |
| 3 | 625 | 50.0 | 24.5 | 25.8 | 2.81 | 56.3 | 22.3 | 74.9 |

As shown by the data of TABLE 1 in Examples A–E wherein no modifier was added, a dosage of 625 g/T of fatty acid/fuel oil provides optimum recovery of phosphate at commercially preferred collector dosage. Examples 1, 2 and 3 in Table 1 show the results obtained at this collector dosage but with varying amounts of modifier, with the modifier being added before the collector. Examples 1–3 show that the addition of the modifier in this manner improved the grade of BPL concentrate from about 50% to about 56%. Example 3 shows that at the highest dosage of modifier, the recovery of BPL ($P_2O_5$) decreased from 92.6% to about 75%. In addition, for the highest dosage of modifier in Example 3, the % insolubles in the BPL concentrate was decreased from 32% to about 22%.

At the lowest dosage of modifier at 12.5 g/T, shown in Example 1, the metallurgy may be quite acceptable, i.e., 88.7% BPL recovery and 56.1% BPL grade in the concentrate. Moreover, in Example 1 the insolubles in the concentrate decreased from 32% to about 24%.

Examples 1–3 demonstrate that with this order of addition for the reagents i.e., modifier first followed by addition of anionic collector, the modifier does decrease the overall phosphate recovery. Examples 1–3 demonstrate that with this order of addition for the reagents, i.e. modifier first followed by addition of anionic collector, the modifier does decrease the overall phosphate recovery generally. In related testing conducted by applicants with this order of addition and with varying concentrations of calcium ion in the process water, applicants have observed that phosphate recovery generally decreases with increasing calcium concentration. These results are believed to be caused by precipitation of the collector as a calcium complex or soap.

EXAMPLES 4–7

In the following examples, Feed B was used. Flotation testing was performed, this time keeping the collector/extender (50/50 wt/ratio) dosage constant at 1000 g/T, employing two dosages for the modifier but varying the order of addition for the modifier and collector as shown. The test results are set forth in Table 2, as follows:

TABLE 2

PHOSPHATE FLOTATION AS A FUNCTION OF MODIFIER DOSAGE AND ORDER OF ADDITION
Feed B: $P_2O_5$ = 7.43; BPL = 16.20; pH = 9.0

| EXAMPLE | COLLECTOR EXTENDER DOSAGE/g/T | MODIFIER DOSAGE, g/T | WT. % CONC. | ASSAY, $P_2O_5$ % CONC. | ASSAY, $P_2O_5$ % TAILS | CONC. GRADE BPL, % | INSOLS. IN CONC., % | $P_2O_5$ RECOVERY |
|---|---|---|---|---|---|---|---|---|
| A. ORDER OF ADDITION: MODIFIER THEN FATTY ACID: | | | | | | | | |
| 4 | 1000 | 12.5 | 40.5 | 16.91 | 0.77 | 36.86 | 50.00 | 93.7 |
| 5 | 1000 | 25 | 36.8 | 18.91 | 0.87 | 41.22 | 43.20 | 92.7 |
| B. ORDER OF ADDITION: FATTY ACID THEN MODIFIER: | | | | | | | | |
| 6 | 1000 | 12.5 | 42.4 | 16.86 | 0.46 | 36.75 | 45.12 | 96.4 |
| 7 | 1000 | 25.0 | 38.4 | 19.50 | 0.44 | 42.51 | 42.57 | 96.5 |
| F | 1000 | — | 49.4 | 14.39 | 0.51 | 31.37 | 56.66 | 96.5 |

It is apparent from the data of Table 2 that the addition of the modifier after conditioning the ore with an anionic fatty acid collector is unexpectedly superior to the reverse order of addition. More particularly, the grade of the phosphate concentrate increases from about 31.4% BPL in the absence of modifier (Example F) to about 42.5% BPL at 25 g/T of the modifier (Example 7). The phosphate recovery remained unchanged at about 96% (compare Examples F and 7). Moreover, the % insolubles in the phosphate concentrate decreased dramatically from about 57% (Example F) to about 43% (Example 7). On the other hand, when the modifier was added before addition of the collector, in accordance with conventional methods, the grade of the phosphate concentrate was improved, but at the expense of phosphate recovery. (Compare Examples 4 and 5 with Example F).

EXAMPLES 8–10

Feed B was once again used in this series of tests to determine the effect of conditioning time on the performance of the modifier. In these tests the modifier was added to the pulp first and conditioned for the time indicated, followed by addition of the fatty acid with conditioning for the time indicated. The results obtained are set forth in Table 3, as follows:

TABLE 3

PHOSPHATE FLOTATION AS A FUNCTION OF CONDITIONING TIME
Feed B: $P_2O_5$ = 7.43; BPL = 16.20; pH 9.0
Order of Addition: Modifier then Collector

| Example | MODIFIER Dosage, g/T | MODIFIER Conditioning Time, min. | COLLECTOR Dosage, g/T | COLLECTOR Conditioning Time, min. | wt % Conc. | Assay, $P_2O_5$ % Conc. | Assay, $P_2O_5$ % Tails | BPL grade of Conc. % | Insols. in Conc. % | $P_2O_5$ Recov. % |
|---|---|---|---|---|---|---|---|---|---|---|
| G | — | — | 1000 | 0.5 | 45.62 | 14.07 | 0.89 | 30.67 | 57.5 | 93.0 |
| H | — | — | 1000 | 1.0 | 45.62 | 14.86 | 0.77 | 32.39 | 55.0 | 94.1 |
| I | — | — | 1000 | 2.0 | 49.40 | 14.39 | 0.51 | 31.37 | 56.66 | 96.5 |
| 8 | 25.0 | 0.5 | 1000 | 0.5 | 10.32 | 14.08 | 6.64 | 30.69 | 58.25 | 19.6 |
| 9 | 25.0 | 1.0 | 1000 | 1.0 | 31.96 | 19.50 | 1.97 | 42.51 | 42.82 | 82.3 |
| 10 | 25.0 | 2.0 | 1000 | 2.0 | 37.00 | 19.29 | 1.05 | 42.05 | 43.71 | 91.6 |

As can be seen from the data of Table 3, a short conditioning time of less than about 2.0 minutes is not beneficial, especially in the presence of the modifier. For example, at only 0.5 minutes conditioning time at a modifier dosage of 25 g/T (Example 8), the $P_2O_5$ recovery was only about 20% and at a grade of about 31% BPL, whereas in the absence of the modifier, recovery was 93% with an identical BPL grade, as shown in Example G. It should be noted that the order of addition for Examples 8–10 was modifier before fatty acid collector.

When the conditioning time was longer, at about 2 minutes, the addition of the modifier improves the BPL grade from about 31.4% to about 42% with a recovery drop of only 5 units (Compare Example I with Example 10). This improvement in the performance of the modifier is also reflected in the significant drop in % insolubles content of the phosphate concentrate of from about 56.7% (Example I) without modifier, to about 43.7% (Example 10) with 25 g/T modifier.

EXAMPLES 11–15

In this series of Example, further testing was conducted to investigate the effect of higher dosages of modifier when the order of addition was collector followed by modifier. The results are set forth in Table 4 as follows:

TABLE 4

PHOSPHATE FLOTATION AT HIGHER DOSAGES OF MODIFIER
Feed B: $P_2O_5$ = 7.43; BPL = 16.20; pH 9.0
Order of Addition: Collector then Modifier

| | Fatty acid/Fuel oil | | Modifier | | | Assay, % $P_2O_5$ | | BPL | | |
|---|---|---|---|---|---|---|---|---|---|---|
| Example | g/T | Cond. Time, min. | g/T | Cond. Time, min. | wt % conc. | conc. | Tails | grade of conc. | Insols. in conc. % | $P_2O_5$ recovery % |
| J | 1000 | 2 | — | — | 49.17 | 14.70 | 0.51 | 32.04 | 56.49 | 96.5 |
| K | 1000 | 2 | — | — | 49.40 | 14.39 | 0.51 | 31.37 | 56.66 | 96.5 |
| 11 | 1000 | 2 | 12.5 | 2 | 42.40 | 16.86 | 0.46 | 36.75 | 45.12 | 96.4 |
| 12 | 1000 | 2 | 25.0 | 2 | 38.41 | 19.50 | 0.44 | 42.51 | 42.57 | 96.5 |
| 13 | 1000 | 2 | 50.0 | 2 | 38.39 | 18.86 | 0.31 | 41.12 | 45.00 | 97.5 |
| 14 | 1000 | 2 | 75.0 | 2 | 35.28 | 20.32 | 0.33 | 44.30 | 40.37 | 97.1 |
| 15 | 1000 | 2 | 50 + 50 | 2 | 29.35 | 24.58 | 0.57 | 53.58 | 27.79 | 94.7 |

As shown by the data in Table 4, when no modifier is added, the BPL grade and recovery were 32% and 96.5%, respectively (Example J). With the addition of the modifier at dosages of 12.5, 25, 50, 75 and 100 g/T, the BPL grade increases to 36.8%, 42.5%, 41.1%, 44.3% and 53.6%, respectively, although the BPL recovery remains almost constant or increases slightly (Compare Examples 11–15). At a dosage of 75 g/T of modifier, as shown in Example 14, the BPL grade was 44.3% and BPL recovery was 97.1%. In Example 15, the modifier was added in stages, 50 g/T during conditioning of the pulp and 50 g/T added to the flotation cell, for a total dosage of 100 g/T. With this step-wise addition of the modifier, a very high BPL grade of 53.6% and a high BPL recovery of 94.7% were obtained. Examples 11–15 demonstrate the addition of the modifier after conditioning with the anionic collector is beneficial as are higher dosages of the modifier. The step-wise treatment with the modifier shown in Example 15 is especially beneficial for obtaining high phosphate recovery and grade.

EXAMPLES 16–19

Feed B was used in the following examples. Flotation testing was performed to demonstrate the beneficial effects of longer conditioning time when the order of addition was collector followed by modifier. The flotation tests and results obtained are set forth in Table 5 as follows:

TABLE 5

PHOSPHATE FLOTATION AS A FUNCTION OF MODIFIER CONDITIONING TIME
Feed B: $P_2O_5$ = 7.43; BPL = 16.2, pH = 9.0
Order of Addition: Collector then Modifier

| | Fatty acid/Fuel oil | | Modifier | | | Assay, % $P_2O_5$ | | BPL | | |
|---|---|---|---|---|---|---|---|---|---|---|
| Example | g/T | Cond. Time, min. | g/T | Cond. Time, min. | wt % conc. | conc. | Tails | grade of conc. | Insols. in conc. % | $P_2O_5$ recovery % |
| L | 1000 | 2.0 | — | — | 49.17 | 14.70 | 0.51 | 32.04 | 56.49 | 96.5 |
| M | 1000 | 2.0 | — | — | 49.40 | 14.39 | 0.51 | 31.37 | 56.66 | 96.5 |
| 16 | 1000 | 2.0 | 25 | 0.5 | 41.87 | 17.77 | 0.44 | 38.74 | 47.17 | 96.7 |
| 17 | 1000 | 2.0 | 25 | 2.0 | 38.41 | 19.50 | 0.44 | 42.51 | 42.57 | 96.5 |
| 18 | 1000 | 2.0 | 25 | 4.0 | 40.45 | 18.04 | 0.31 | 39.33 | 46.79 | 97.6 |
| 19* | 1000 | 4.0 | 25 | 4.0 | 34.75 | 21.00 | 0.98 | 45.73 | 38.37 | 92.0 |

*the order of addition for this test was reversed; viz. Modifier first, followed by fatty acid As shown by the data in Table 5, at a modifier dosage of 25 g/T, the longer the conditioning time, the better the performance. In those runs, wherein no modifier was added, the BPL grade and recovery were 32% and 96.5%, respectively (Examples L and M). With a modifier dosage of 25 g/T, added after conditioning with fatty acid/fuel oil collector, the BPL grade increased to 38.7% at only 30 seconds of conditioning with the modifier, and BPL recovery remained unchanged at about 96.5% (Compare tests L and M with Example 16.) When the conditioning time with the modifier was increased to about 2 minutes, the BPL grade increased to 42.5% and BPL recovery remained unchanged, as demonstrated in Example 17. In Example 19, the order of addition was reversed, i.e., modifier then collector, and both the modifier and the collector were conditioned for a period of four minutes each. In Example 15, the BPL grade increased to 45.7%, but at the expense of a loss in recovery of from 96.5% to about 92%.

The dramatic improvement in BPL grade from 32% (Examples L and M) to 45.7% with the modifier (Example 19) may more than offset the relative recovery drop from 96.5% to 92%. The less beneficial effect of adding the modifier before the collector might therefore be overcome by providing long conditioning times.

EXAMPLES 20–23

In the following examples, Feed C was used to confirm the beneficial effects of adding the modifier to the anionic flotation stage, even with a feed change. The flotations conducted and results obtained are set forth in Table 6 as follows:

TABLE 6

IMPROVED PHOSPHATE FLOTATION AT VARYING MODIFIER DOSAGES
Feed C: Head $P_2O_5$ = 8.27; BPL = 18.03; pH = 9.0
Order of Addition: Collector then Modifier

| | Fatty acid/Fuel oil | | Modifier | | | Assay % $P_2O_5$ | | BPS | | |
|---|---|---|---|---|---|---|---|---|---|---|
| Example | g/T | Cond. Time, min. | g/T | Cond. Time, min. | wt % conc. | conc. | Tails | grade of conc. | Insols. in conc. % | $P_2O_5$ recovery % |
| N | 1000 | 2 | — | — | 40.35 | 17.83 | 0.75 | 38.87 | 46.58 | 94.1 |
| 20 | 1000 | 2 | 12.5 | 2 | 41.57 | 19.47 | 0.54 | 42.45 | 43.33 | 96.24 |
| 21 | 1000 | 2 | 25.0 | 2 | 40.30 | 20.29 | 0.52 | 44.24 | 41.38 | 96.35 |
| 22 | 1000 | 2 | 50.0 | 2 | 35.96 | 21.98 | 0.54 | 47.92 | 36.11 | 95.80 |
| 23 | 1000 | 2 | 75.0 | 2 | 33.98 | 24.28 | 0.50 | 52.92 | 28.68 | 96.19 |

The data of Table 6 demonstrate the benefits provided in a non-sulfide anionic flotation in accordance with the new and improved method of the present invention. The results presented in Table 6 are consistent with the improved results obtained with the use of the modifier on Feeds A and B. As shown in Table 6, in Example N wherein no modifier was added, the BPL grade and recovery was 38.9% and 94.1%, respectively. When the modifier was added after conditioning with the collector, at dosages of 12.5, 25, 50 and 75 g/T, the BPL grade increased to 42.5%, 44.2%, 47.9% and 52.9%, respectively and the BPL recovery was higher at about 96.2%, 96.4%, 95.8% and 96.2, respectively (Examples 20–23 respectively).

EXAMPLES 24–36

In the following examples, Feed C was used again to evaluate the performance of the modifier at lower dosages of the anionic collectors. More particularly, in the following examples, flotation testing was performed at 250, 300, 375 and 500 g/T dosages of 1:1 w:w Fatty acid/fuel oil collector. Modifier dosage was varied at 25, 50 and 75 g/T and examined at each fatty acid dosage. The tests performed and the results obtained are set forth in Table 7 as follows:

TABLE 7

MODIFIER PERFORMANCE AS A FUNCTION OF DOSAGE AND ANIONIC COLLECTOR DOSAGE
Feed C: Head $P_2O_5$ = 8.33; BPL = 18.16; pH = 9.0
Order of Addition: Collector then Modifier

| | Fatty acid/Fuel oil | | Modifier | | | Assay, % $P_2O_5$ | | BPL | | |
|---|---|---|---|---|---|---|---|---|---|---|
| Example | g/T | Conc. Time, min. | g/T | Cond. Time, min. | wt % conc. | conc. | Tails | grade of conc. | Insols. in conc. % | $P_2O_5$ recovery % |
| O | 250 | 2 | — | — | 24.23 | 28.75 | 2.51 | 62.67 | 17.91 | 78.5 |
| P | 300 | 2 | — | — | 29.47 | 26.38 | 0.74 | 57.50 | 25.54 | 93.7 |
| Q | 375 | 2 | — | — | 32.81 | 22.76 | 0.95 | 49.62 | 33.65 | 92.1 |
| R | 500 | 2 | — | — | 35.35 | 21.71 | 0.77 | 47.33 | 37.31 | 93.9 |
| 24 | 250 | 2 | 25.0 | 2 | 22.63 | 29.81 | 1.79 | 64.99 | 14.87 | 82.9 |
| 25 | 250 | 2 | 50.0 | 2 | 21.20 | 31.07 | 2.10 | 67.74 | 10.87 | 79.9 |
| 26 | 250 | 2 | 75.0 | 2 | 20.25 | 31.62 | 2.56 | 68.94 | 10.30 | 75.8 |
| 27 | 300 | 2 | 12.5 | 2 | 28.53 | 26.56 | 1.06 | 57.90 | 23.61 | 91.0 |
| 28 | 300 | 2 | 25.0 | 2 | 26.74 | 28.45 | 1.21 | 62.03 | 18.47 | 89.6 |
| 29 | 300 | 2 | 50.0 | 2 | 25.19 | 29.66 | 1.26 | 64.66 | 15.09 | 88.8 |
| 30 | 300 | 2 | 75.0 | 2 | 23.98 | 30.51 | 1.52 | 66.51 | 12.67 | 86.4 |
| 31 | 375 | 2 | 25.0 | 2 | 29.60 | 26.26 | 0.83 | 57.25 | 23.56 | 93.0 |
| 32 | 375 | 2 | 50.0 | 2 | 28.65 | 26.85 | 0.90 | 58.54 | 21.87 | 92.3 |
| 33 | 375 | 2 | 75.0 | 2 | 26.53 | 29.07 | 0.90 | 63.38 | 16.85 | 92.1 |
| 34 | 500 | 2 | 25.0 | 2 | 32.34 | 24.19 | 0.77 | 52.74 | 30.19 | 93.8 |
| 35 | 500 | 2 | 50.0 | 2 | 33.03 | 23.84 | 0.56 | 51.98 | 31.15 | 95.4 |
| 36 | 500 | 2 | 75.0 | 2 | 29.26 | 25.66 | 0.74 | 55.93 | 26.11 | 93.5 |

As shown by the data of Table 7, at each dosage for the anionic collector, the addition of the modifier dramatically improved the BPL grade of the concentrate with some recovery loss at lower fatty acid dosages. A fatty acid/fuel oil dosage of about 375 g/T and a modifier dosage of 75 g/T appeared to provide optimum performance as shown in Example 33 wherein a BPL grade of about 63.4% and a BPL recovery of about 92.1% were achieved. Example 33 should be contrasted with Example Q wherein, under identical conditions without any modifier being added, the BPL grade and recovery obtained were only 49.6% and 92.1%, respectively.

EXAMPLES 37–39

In the previous examples, the dramatic improvement in the BPL grades obtained by employing the modifier in the anionic rougher flotation in accordance with the method of this invention was demonstrated, particularly where the modifier was added after the anionic collector. These improved results for the rougher flotation stages are beneficial; however, from the perspectives of plant operation, it was important to investigate whether this grade improvement was sufficiently large to provide marketable $P_2O_5$ concentrates merely by cleaning the rougher concentrate once in a cleaner flotation, and thereby eliminate the subsequent commercially employed acid-scrubbing and amine flotation stages.

These following examples demonstrate the process of the present invention in terms of a cleaner flotation process wherein the rougher concentrate is cleaned in one or more stages to obtain higher and higher grades of the non-sulfide mineral concentrates.

In the following Examples, a cleaner flotation process was used on Feed C. In the rougher stage flotation 300 g/T of the fatty acid/fuel oil collector was used to condition the pulp slurry and thereafter the pulp was conditioned with 25 g/T of the modifier. The rougher flotation was performed and the concentrate collected was re-slurried and conditioned again respectively with 30 g/T of the collector and 2.5 g/T of the modifier. The re-conditioned concentrate slurry was floated to provide a cleaner concentrate and cleaner tailings.

The results of the cleaner flotation process are set forth in Table 8 as follows:

TABLE 8

CLEANER FLOTATION WITH MODIFIER
Feed C: Head $P_2O_5$ = 8.33; BPL = 18.16, pH = 9.0
Order of Addition: Fatty Acid then Modifier

| | g/T Fatty acid/F.O. | | g/T Modifier | | % $P_2O_5$ Final concentrate | | | % $P_2O_5$ Cl. Tails | | % $P_2O_5$ Final Tails | |
|---|---|---|---|---|---|---|---|---|---|---|---|
| Example | Ro* | Cl.+ | Ro | Cl. | Rec. | Grade | Insol. | Rec. | grade | Loss | grade |
| 37 | 300 | 30 | 25 | 2.5 | 74.9 | 70.73 | 6.7 | 14.0 | 34.7 | 11.1 | 2.75 |
| 38 | 300 | 30 | 25 | — | 77.9 | 71.33 | 7.0 | 11.5 | 30.2 | 10.6 | 2.68 |
| 39 | 300 | — | 25 | 2.5 | 69.4 | 71.57 | 6.4 | 19.5 | 39.1 | 11.0 | 2.74 |

*Ro is Rougher
+Cl is Cleaner

The data of Table 8 demonstrate that marketable grade phosphate concentrates can be produced by flotation with anionic collectors and the modifier at a dosage of about 25 g/T. The costs of additional reagent used in the cleaner flotation stage is small compared to the cost of the conventional acid-scrubbing and amine flotation stages.

Examples 37–39 illustrate that a BPL grade of over 70% with an insolubles content of under 7% can be achieved in an anionic flotation only, if the modifier is used in accordance with the subject method. Although the final recoveries appear low, e.g., on the order of about 70–75%, phosphate values are not lost in the final tailings in actual plant operations. Typically the phosphate values do report to the cleaner tails, which can be recirculated to the rougher flotation cells, since their grade is already about 30–40%. This recirculation is common or can be easily accomplished at the plant. The only loss of phosphate values, however, is usually the final tails, which amounts to only about 10%. Therefore, the overall recovery of phosphates in this exclusively anionic flotation is about 90%.

Moreover, Examples 37–39 have been provided by way of example only to show the beneficial effects of the modifier. The examples were performed to demonstrate that successively higher grade concentrates may be obtained in an anionic cleaner flotation without resorting to acid scrubbing and secondary amine flotation systems. No attempt was made in Examples 37–39 to optimize the cleaner flotation conditions and for this reason further improvement in grade and especially in recovery would be expected under different conditions determined by experimentation to be optimum.

EXAMPLES 40–45

Feed D was used in the following Examples which were performed at a field lab.

In the field, flotation was performed on Feed D both with and without the modifier.

500 grams of the ore were conditioned at 74–75% solids at a pH of 9.0–0.2 for a total conditioning time of 3.0 minutes, 2.0 minutes for the fatty acid collector, then 1.0 minute for the modifier. Flotation pH was about 7.0–7.5. Flotation solids were 25–30% at rpm 1300. The collector and modifier dosages and flotation results obtained are set forth in Table 9, as follows:

TABLE 9

FIELD TESTING OF MODIFIER IN PHOSPHATE FLOTATION
Feed D: Head $P_2O_5$ = 5.68, BPL = 12.39, pH = 9.0
Order of Addition: Collector then Modifier

| | Fatty acid/Fuel oil | | Modifier | | wt % | Assay, % | | Insols | $P_2O_5$ |
|---|---|---|---|---|---|---|---|---|---|
| Example | lb/t | Time, min. | lb/t | Time, min. | conc. | conc. | Tails | in conc. % | recovery % |
| S | 0.25 | 2 | — | — | 13.20 | 68.26 | 3.62 | 7.25 | 74.1 |
| T | 0.50 | 2 | — | — | 18.70 | 61.76 | 1.62 | 17.46 | 89.8 |
| U | 0.75 | 2 | — | — | 19.50 | 56.74 | 1.62 | 21.57 | 89.5 |
| V | 1.00 | 2 | — | — | 21.80 | 52.07 | 1.56 | 28.44 | 90.3 |
| W | 1.25 | 2 | — | — | 25.10 | 45.59 | 1.12 | 37.12 | 93.2 |
| 40 | 0.75 | 2 | 0.25 | 1 | 22.30 | 62.67 | 1.17 | 14.73 | 93.9 |
| 41 | 0.75 | 2 | 0.35 | 1 | 17.40 | 64.77 | 1.17 | 11.85 | 92.1 |
| 42 | 0.75 | 2 | 0.50 | 1 | 17.30 | 64.49 | 1.67 | 12.33 | 89.0 |
| 43 | 1.00 | 2 | 0.25 | 1 | 17.80 | 62.76 | 1.34 | 15.09 | 91.0 |
| 44 | 1.00 | 2 | 0.35 | 1 | 17.70 | 64.07 | 1.17 | 12.77 | 92.2 |
| 45 | 1.00 | 2 | 0.50 | 1 | 17.20 | 63.65 | 1.62 | 13.97 | 89.1 |

It is quite evident from results shown in Table 9 that there is a substantial improvement in the concentrate grade at both 0.75 and 1.0 lbs/t of fatty acid/fuel oil collector and at all dosages of the novel modifier. At 0.75 lb/t of fatty acid collector and in the absence of the modifier (Example U) the recovery and grade of the $P_2O_5$ concentrate were 89.5% and 56.74%, respectively. When only 0.25 lb/t of the modifier was added (Example 40), the grade of the concentrate increased from about 56.7% to about 63% with an increase in recovery of from 89.5% to 93.9%.

At 0.35 lb/t of the modifier, as shown by Example 41, the grade of the concentrate increased from 56.7% to about 64.8% and the recovery increased from 89.5% to 92%. At 0.5 lb/t of the modifier (Example 42), the concentrate grade improvement was from 56.7% to about 64.5% with a slight decrease in recovery of from 89.5% to about 89.0%. Substantially similar results were obtained at a collector dosage of 1.0 lb/t and 0.25–0.50 lb/t of modifier (Compare Example V with Examples 43–45). At each collector dosage using the modifier in accordance with this invention, the improved grades of the concentrate are also reflected in the significant lowering of the % insolubles reporting to the concentrates.

EXAMPLES 46–50

In these examples Feed C was used to investigate the effects of molecular weight and the degree of glyoxylic acid substitution of the modifier on its flotation performance. The tests performed and the results obtained are set forth in Table 10 as follows:

TABLE 10

PHOSPHATE FLOTATION AS A FUNCTION OF MOLECULAR WEIGHT AND DEGREE OF SUBSTITUTION OF THE MODIFIER
Feed C: Head $P_2O_5$ = 8.33; BPL = 18.16%: pH = 9.0
Order of addition: Collector then modifier

| | Fatty acid/Fuel oil | | | | | |
|---|---|---|---|---|---|---|
| Example | g/T | Cond. Time | Modifier (25 g/T; Cond. Time 2 min.) | BPL grade of conc., % | BPL recover, % | Insols. in conc., % |
| X | 300 | 2 min. | None | 53.9 | 90.8 | 28.21 |
| Y | 300 | 2 min. | None | 52.5 | 87.3 | 31.17 |
| Z | 300 | " | Phossaver - a commercial phosphate depressant used in amine flotation. (A starch product). | 57.5 | 86.2 | 22.97 |
| AA | 300 | | PAM, ~ 7K | 49.4 | 89.9 | 34.57 |
| 46 | 300 | " | Novel Modifier used in examples 1–45 | 61.7 | 88.8 | 19.17 |
| 47 | 300 | " | PAM + 10% GA, ~ 7K* | 63.0 | 88.6 | 17.21 |
| 48 | 300 | " | PAM + 10% GA, ~ 20K | 55.1 | 89.4 | 27.09 |
| 49 | 300 | " | PAM + 10% GA, ~ 50K | 63.5 | 86.5 | 16.9 |
| 50 | 300 | " | PAM + 20% GA, ~ 7K | 64.2 | 85.5 | 14.11 |

*PAM is polyacrylamide; GA is glyoxylic acid; 7K means an average molecular weight of 7000; and % GA is in terms of weight percent of glyoxylic acid.

The results in Table 10, as illustrated by Examples 46–50, show that excellent results are obtained with the process of this invention wherein the modifier has a molecular weight in the range of from about 5,000 to about 50,000 and the % substitution for glyoxylic acid is in the range of from about 5 to 30%, preferably about 10–20%. These ranges are illustrative only and reflect materials actually tested. Those skilled in the art will be able to easily optimize the molecular weight, the % substitution of glyoxylic acid and/or the degree or number of carboxyl groups on the polymer backbone to obtain the best performance under any given conditions.

As shown in Table 10, in the absence of the modifier, the BPL grade and recovery were 52.5–53.9% and 87.3–90.8% respectively. The use of the modifier at 25 g/T added after conditioning with the anionic collector improves the grade of the concentrate to from about 60–64% and this improvement is obtained without seriously affecting BPL recoveries.

Although the present invention has been described with reference to certain preferred embodiments, modifications or changes may be made therein by those skilled in this art. For example, instead of a phosphate ore, the method may be used to beneficiate other non-sulfide mineral ores amenable to flotation with anionic collectors which contain associated siliceous gangue minerals or materials, such as anhydrite, apatite, barite, brucite, calcite, cassiterite, cerussite, celestite, dolomite, fluorite, gypsum, hematite, magnetite, pyrolusite, scheelite, spodumene, and bastnesite, to name but a few. Instead of fatty acid collectors, other anionic collectors such as the sulfonates and sulfates may be used. Boosters, such as surfactants like esters of sulfosuccinic acid such as the boosters described in any of U.S. Pat. Nos. 4,138,350; 4,139,481; 4,139,482; 4,147,644; 4,148,720; and 4,233,150, and like materials may be employed if desired. Furthermore, as has been mentioned above, other nonionic and/or anionic monomers may be incorporated into the copolymer or terpolymer depressants, so long as the resulting depressant exhibits the desired selectivity and effectiveness in depressing siliceous gangue. All such obvious modifications may be made by those skilled in the art without departing from the scope and spirit of the present invention as defined in the appended claims.

What is claimed is:

1. A method for froth flotation of non-sulfide value minerals with selective depression of associated siliceous gangue minerals and materials, said method comprising:

(a) providing an aqueous pulp slurry of finely-divided, liberation-sized non-sulfide particles;
(b) adjusting the pH of said pulp slurry to a value of between about 5 and 11;
(c) conditioning said pulp slurry with an effective amount of an anionic collector;
(d) further conditioning said pulp slurry with an effective amount of a depressant selective for siliceous gangue minerals and materials, said depressant comprising a polymer derived from:
(i) x units of the formula:

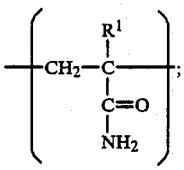

(ii) y units of the formula:

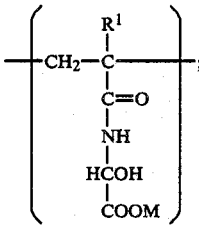

and
(iii) z units of the formula:

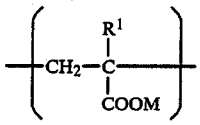

wherein $R^1$ is hydrogen or $C_1$–$C_4$ alkyl; M is hydrogen, an alkali metal cation or ammonium ion; x represents the residual mol percent fraction; y is a mol percent fraction ranging from about 1% to about 50%; z is a mol percent fraction ranging from about 0% to about 45%, and the average molecular weight of the polymer is between about 500 and about 1,000,000; and (e) collecting the non-sulfide value minerals by froth flotation procedures.

2. A method as recited in claim 1, wherein the aqueous pulp slurry provided has a solids content of from about 60% to about 80%.

3. A method as recited in claim 1, wherein the pH of the pulp slurry is adjusted to a value of about 9.0 in step (b) by adding dilute aqueous alkali metal hydroxide or ammonia.

4. A method as recited in claim 1, wherein the anionic collector comprises a fatty acid collector.

5. A method as recited in claims 1 wherein said anionic collector comprises a tall oil fatty acid.

6. A method as recited in claim 1 wherein said anionic collector comprises a blend or an emulsion of a fatty acid collector and a petroleum-based hydrocarbon oil extender.

7. A method as recited in claim 1, wherein the amount of anionic collector added is from about 0.2 to about 4.0 lbs. of collector/ton of ore.

8. A method as recited in claim 1, wherein the pulp slurry is conditioned with anionic collector by adding the anionic collector and agitating the pulp slurry for a period of between about 0.5 and 30 minutes.

9. A method as recited in claim 1, wherein the anionic collector comprises a 1:1 w/w blend of tall oil fatty acid and fuel oil added in an amount of from about 100 to about 2000 grams of the collector blend per metric ton of ore.

10. A method as recited in claim 1, wherein the depressant comprises a copolymer derived from (i) units and (ii) units.

11. A method as recited in claim 1, wherein, the depressant comprises a copolymer derived from about 70 to 95 mol percent of (i) units and from about 5 to 30 mol percent of (ii) units.

12. A method as recited in claim 1 wherein the depressant is added in an amount of from about 10 grams to about 250 grams of depressant per metric ton of ore.

13. A method as recited in claim 1, wherein the slurry is conditioned with the depressant, by adding the depressant while agitating the slurry and continuing agitation for a period of from about 0.5 to about 10 minutes.

14. A method as recited in claim 1 wherein the non-sulfide ore is a phosphate ore and the pH is adjusted in step (b) to a value of between about 8.5 and 10.

15. A method for froth flotation beneficiation of non-sulfide value minerals from non-sulfide ores with selective depression of siliceous gangue minerals and materials, said method comprising:

(a) providing an aqueous pulp slurry of finely-divided, liberation-sized ore particles;

(b) adjusting the pH of said pulp slurry to a value of between about 5 and 11;

(c) conditioning said pulp slurry with an effective amount of an anionic collector;

(d) further conditioning said pulp slurry with an effective amount of a depressant selective for siliceous gangue minerals and materials, said depressant comprising a copolymer or terpolymer derived from:

(i) x units of the formula:

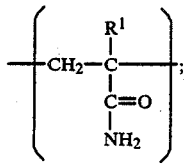

(ii) y units of the formula:

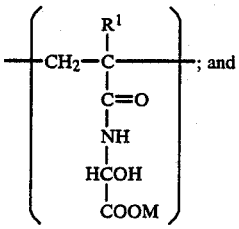

and (iii) z units of the formula:

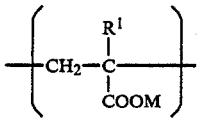

wherein $R^1$ is hydrogen or $C_1$–$C_4$ alkyl; M is hydrogen, an alkali metal cation or ammonium ion; x represents the residual mol percent fraction; y is a mol percent fraction ranging from about 1% to about 50%; z is a mol percent fraction ranging from about 0% to about 45%, and the average molecular weight of the copolymer or terpolymer is between about 500 and about 1,000,000; and (e) collecting the non-sulfide value minerals by froth flotation procedures.

16. A method according to claims 1 or 15 wherein the aqueous pulp slurry contains divalent ions.

* * * * *